US011521564B2

(12) United States Patent
Li et al.

(10) Patent No.: US 11,521,564 B2
(45) **Date of Patent: *Dec. 6, 2022**

(54) IMAGE DISPLAY PROCESSING METHOD AND DEVICE, DISPLAY DEVICE AND NON-VOLATILE STORAGE MEDIUM

(71) Applicants: BEIJING BOE OPTOELECTRONICS TECHNOLOGY CO., LTD., Beijing (CN); BOE TECHNOLOGY GROUP CO., LTD., Beijing (CN)

(72) Inventors: Wenyu Li, Beijing (CN); Jinghua Miao, Beijing (CN); Yukun Sun, Beijing (CN); Xuefeng Wang, Beijing (CN); Zhifu Li, Beijing (CN); Bin Zhao, Beijing (CN); Xi Li, Beijing (CN); Lixin Wang, Beijing (CN); Qingwen Fan, Beijing (CN); Jianwen Suo, Beijing (CN); Yali Liu, Beijing (CN); Hao Zhang, Beijing (CN); Lili Chen, Beijing (CN); Zhihua Ji, Beijing (CN); Jinbao Peng, Beijing (CN); Ziqiang Guo, Beijing (CN); Xiurong Wang, Beijing (CN)

(73) Assignees: BEIJING BOE OPTOELECTRONICS TECHNOLOGY CO., LTD., Beijing (CN); BEIJING BOE TECHNOLOGY DEVELOPMENT CO., LTD., Beijing (CN)

( * ) Notice: Subject to any disclaimer, the term of this patent is extended or adjusted under 35 U.S.C. 154(b) by 0 days.

This patent is subject to a terminal disclaimer.

(21) Appl. No.: 17/241,618

(22) Filed: Apr. 27, 2021

(65) Prior Publication Data

US 2021/0248966 A1 Aug. 12, 2021

Related U.S. Application Data

(63) Continuation of application No. 16/400,459, filed on May 1, 2019, now Pat. No. 11,030,964.

(30) Foreign Application Priority Data

Aug. 9, 2018 (CN) ..... 201810903627.6

(51) Int. Cl.
*G09G 3/34* (2006.01)
*G09G 3/36* (2006.01)

(52) U.S. Cl.
CPC ..... *G09G 3/342* (2013.01); *G09G 3/3607* (2013.01); *G09G 2320/0238* (2013.01); *G09G 2320/066* (2013.01); *G09G 2320/0653* (2013.01)

(58) Field of Classification Search
CPC ..... G09G 3/342; G09G 3/3607; G09G 2320/0238; G09G 2320/0653;
(Continued)

(56) References Cited

U.S. PATENT DOCUMENTS

2007/0120808 A1* 5/2007 Shimoda ..... G09G 3/3611 345/102
2008/0123022 A1* 5/2008 Aoki ..... G09G 3/3426 349/68
(Continued)

FOREIGN PATENT DOCUMENTS

CN 1870120 A 11/2006
CN 101777312 A 7/2010
(Continued)

OTHER PUBLICATIONS

Chinese Office Action dated Nov. 1, 2019.
Second Chinese Office Action from Chinese Application No. 201810903627.6 dated May 7, 2020.

*Primary Examiner* — Carolyn R Edwards
(74) *Attorney, Agent, or Firm* — Dilworth & Barrese, LLP.; Michael J. Musella, Esq.

(57) ABSTRACT

An image display processing method for a display device, an image display processing device, a display device, and a non-volatile storage medium are provided. The display device includes a backlight unit and a display panel, the backlight unit includes a plurality of backlight blocks and is driven by a local dimming mode, and the image display processing method includes: obtaining initial backlight data of each of the plurality of backlight blocks corresponding to a display image; performing a peak driving process on the initial backlight data of each of the plurality of backlight blocks by a graphics processing unit to obtain adjusted backlight data of each of the plurality of backlight blocks; and providing the adjusted backlight data to the backlight unit by the graphics processing unit so that the display panel displays the display image.

19 Claims, 10 Drawing Sheets

(58) Field of Classification Search
CPC ..... G09G 2320/066; G09G 2320/0646; G09G 2360/16; G09G 3/3426; G09G 3/3406; G09G 3/36
See application file for complete search history.

(56) References Cited

U.S. PATENT DOCUMENTS

| | | | | |
|---|---|---|---|---|
| 2012/0139885 | A1* | 6/2012 | Iwasa | G09G 3/3426 345/207 |
| 2014/0267466 | A1* | 9/2014 | Takagi | G09G 3/36 345/691 |
| 2017/0061902 | A1* | 3/2017 | Zhang | G09G 3/3426 |
| 2018/0182356 | A1* | 6/2018 | Seong | G09G 3/3426 |
| 2018/0218690 | A1 | 8/2018 | Zhou et al. | |
| 2018/0350308 | A1* | 12/2018 | Zhang | G09G 3/342 |
| 2019/0295504 | A1* | 9/2019 | Xiong | G09G 5/10 |
| 2019/0355296 | A1* | 11/2019 | Ji | G02F 1/133603 |
| 2020/0027408 | A1* | 1/2020 | Xi | G09G 3/3426 |

FOREIGN PATENT DOCUMENTS

| | | | |
|---|---|---|---|
| CN | 102324222 | A | 1/2012 |
| CN | 105185328 | A | 12/2015 |
| CN | 106023905 | A | 10/2016 |
| CN | 106981273 | A | 7/2017 |

* cited by examiner

IMAGE DISPLAY PROCESSING METHOD AND DEVICE, DISPLAY DEVICE AND NON-VOLATILE STORAGE MEDIUM

The present application is a continuation application of U.S. Ser. No. 16/400,459 filed on May 1, 2019 which claims priority of the Chinese Patent Application No. 201810903627.6, filed on Aug. 9, 2018, the disclosure of which is incorporated herein by reference in its entirety as part of the present application.

TECHNICAL FIELD

Embodiments of the present disclosure relate to an image display processing method for a display device, an image display processing device, a display device and a non-volatile storage medium.

BACKGROUND

With the continuous progress of electronic technology, virtual reality (VR) or augmented reality (AR) technology as a high-tech, has been increasingly applied in daily life such as games, entertainment, etc. Virtual reality technology is also known as immersive technology or artificial environment.

The existing virtual reality system simulates a virtual three-dimensional world mainly through a high-performance computing system including a central processing unit, and provides users with sensory experience of vision, hearing, etc., through a head-mounted device, so as to enable the users to feel like being present, and moreover, human-computer interaction can also be available.

SUMMARY

At least one embodiment of the present disclosure provides an image display processing method for a display device, the display device includes a backlight unit and a display panel, the backlight unit includes a plurality of backlight blocks and is driven by a local dimming mode, and the image display processing method includes: obtaining initial backlight data of each of the plurality of backlight blocks corresponding to a display image; performing a peak driving process on the initial backlight data of each of the plurality of backlight blocks by a graphics processing unit to obtain adjusted backlight data of each of the plurality of backlight blocks; and providing the adjusted backlight data to the backlight unit by the graphics processing unit so that the display panel displays the display image.

For example, the image display processing method provided by some embodiments of the present disclosure further includes: obtaining backlight diffusion data of each pixel of the display image; and compensating initial display data of each pixel of the display image according to the backlight diffusion data of each pixel of the display image to obtain compensated display data of each pixel of the display image.

For example, in the image display processing method provided by some embodiments of the present disclosure, the graphics processing unit fits to obtain a backlight diffusion model according to the adjusted backlight data of each of the plurality of backlight blocks, and obtains the backlight diffusion data of each pixel of the display image according to the backlight diffusion model.

For example, in the image display processing method provided by some embodiments of the present disclosure, compensating the initial display data of each pixel of the display image according to the backlight diffusion data of each pixel of the display image includes: by the graphics processing unit, obtaining a maximum value of the backlight diffusion data according to the backlight diffusion data of each pixel of the display image, and then compensating the initial display data of each pixel of the display image according to the backlight diffusion data of each pixel of the display image, the maximum value of the backlight diffusion data and the initial display data of the display image.

For example, in the image display processing method provided by some embodiments of the present disclosure, the compensated display data of each pixel are expressed as:

$$R=Hm*A.r+(bl_\max-Y)*A.r;$$

$$G=Hm*A.g+(bl_\max-Y)*A.g;$$

$$B=Hm*A.b+(bl_\max-Y)*A.b;$$

where R, G and B respectively represent compensated display data of three sub-pixels, which includes a red sub-pixel, a green sub-pixel and a blue sub-pixel, of the each pixel; A.r, A.g and A.b respectively represent initial display data of the three sub-pixels of the pixel before performing local dimming; bl_max represents the maximum value of the backlight diffusion data; Y represents the backlight diffusion data of the pixel, and Hm represents a greatest grayscale value.

For example, in the image display processing method provided by some embodiments of the present disclosure, the display device further includes a central processing unit; the graphics processing unit transmits the adjusted backlight data to the central processing unit of the display device; and the central processing unit provides the adjusted backlight data to the backlight unit under control of a synchronization signal.

For example, in the image display processing method provided by some embodiments of the present disclosure, the graphics processing unit provides compensated display data to the display panel under control of the synchronization signal; and the backlight unit and the display panel work synchronously to display the display image.

For example, in the image display processing method provided by some embodiments of the present disclosure, the synchronization signal is a vertical synchronization signal, and operation that the backlight unit and the display panel work synchronously to display the display image includes: in a case where the vertical synchronization signal is detected, the graphics processing unit transmitting the compensated display data to the display panel, and assigning a beginning flag bit of the adjusted backlight data to a first logic value; determining whether the beginning flag bit of the adjusted backlight data is the first logic value; in a case where the beginning flag bit of the adjusted backlight data is the first logic value, converting the adjusted backlight data to obtain converted backlight data; and transmitting the converted backlight data to a backlight driving circuit to drive a corresponding one of the plurality of backlight blocks in the backlight unit to emit light.

For example, in the image display processing method provided by some embodiments of the present disclosure, the operation that the backlight unit and the display panel work synchronously to display the display image further includes: after transmitting the converted backlight data to the backlight driving circuit, assigning the beginning flag bit of the adjusted backlight data to a second logic value opposite to the first logic value.

For example, in the image display processing method provided by some embodiments of the present disclosure, providing the adjusted backlight data to the backlight unit by the graphics processing unit so that the display panel displays the display image further includes: appending the adjusted backlight data to the compensated display data to obtain composite display data; transmitting the composite display data to the display device under control of a synchronization signal and decoding the composite display data to obtain the adjusted backlight data and the compensated display data; and transmitting the adjusted backlight data after performing of a process of the decoding to the backlight unit, and providing the compensated display data after performing of the process of the decoding to the display panel.

For example, in the image display processing method provided by some embodiments of the present disclosure, obtaining the initial backlight data of each of the plurality of backlight blocks corresponding to the display image includes: obtaining coordinates corresponding to respective pixels of the display image by the graphics processing unit; obtaining grayscale values of respective pixels of the display image according to the coordinates corresponding to respective pixels of the display image by the graphics processing unit; and; obtaining maximum values of the grayscale values of all pixels corresponding to respective backlight blocks respectively as the initial backlight data of the corresponding respective backlight blocks.

For example, the image display processing method provided by some embodiments of the present disclosure further includes: performing distortion correction on an original image to obtain the display image.

At least one embodiment of the present disclosure also provides an image display processing device, which includes: a processing device, including a graphics processing unit; a storage, storing computer executable instructions; wherein, in a case where the computer executable instructions is executed by the processing device, the processing device executes a following method of: obtaining initial backlight data of each of the plurality of backlight blocks corresponding to a display image; performing a peak driving process on the initial backlight data of each of the plurality of backlight blocks by a graphics processing unit to obtain adjusted backlight data of each of the plurality of backlight blocks; and providing the adjusted backlight data to the backlight unit by the graphics processing unit so that the display panel displays the display image.

For example, the image display processing device provided by some embodiments of the present disclosure further includes a central processing unit, wherein the central processing unit is configured to receive the adjusted backlight data transmitted from the graphics processing unit and provide the adjusted backlight data to the backlight unit under control of a synchronization signal.

For example, in the image display processing device provided by some embodiments of the present disclosure, the graphics processing unit is configured to provide compensated display data to the display panel under control of the synchronization signal, to enable that the backlight unit and the display panel work in synchronously to display the display image.

For example, the image display processing device provided by some embodiments of the present disclosure further includes a decoding circuit in a case where composite display data are obtained by the graphics processing unit; wherein the decoding circuit is configured to decode the composite display data into the adjusted backlight data and compensated display data, to provide the adjusted backlight data to the backlight unit, and to provide the compensated display data to the display panel.

At least one embodiment of the present disclosure also provides a display device, which includes the image display processing device provided by any one of the embodiments of the present disclosure, a backlight unit and a display panel.

For example, in the display device provided by some embodiments of the present disclosure, the backlight unit includes a plurality of backlight blocks and is driven by a local dimming mode.

At least one embodiment of the present disclosure also provides a non-volatile storage medium, which stores a computer-readable instruction non-transitorily, in a case where the computer-readable instruction stored non-transitorily is executed by a processing device including a graphics processing unit, the processing device executes a following method of: obtaining initial backlight data of each of the plurality of backlight blocks corresponding to a display image; performing a peak driving process on the initial backlight data of each of the plurality of backlight blocks by a graphics processing unit to obtain adjusted backlight data of each of the plurality of backlight blocks; and providing the adjusted backlight data to the backlight unit by the graphics processing unit so that the display panel displays the display image.

BRIEF DESCRIPTION OF THE DRAWINGS

In order to clearly illustrate the technical solutions of the embodiments of the disclosure, the drawings of the embodiments will be briefly described in the following; it is obvious that the described drawings are only related to some embodiments of the disclosure and thus are not limitative to the disclosure.

DETAILED DESCRIPTION

Figure 1A:
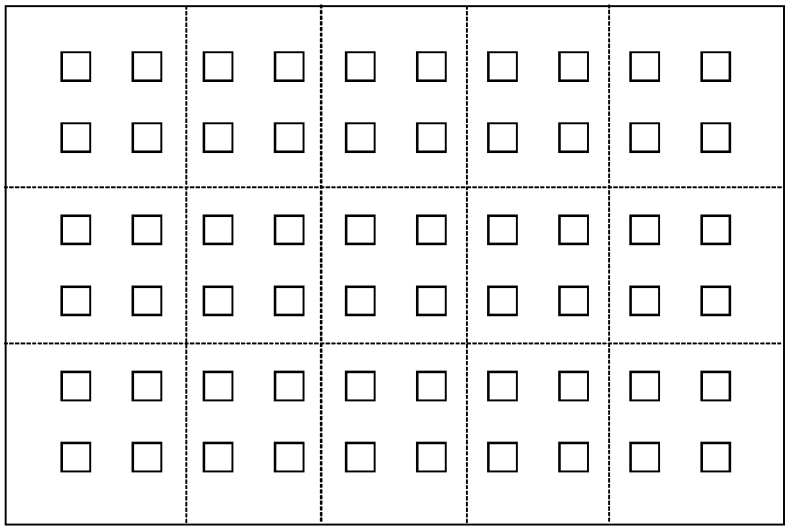
FIG. 1A is a schematic diagram of a backlight unit.

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the present disclosure, are not intended to indicate any sequence, amount or importance, but distinguish various components. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

Hereinafter, various embodiments of the present disclosure are described in detail with reference to the accompanying drawings. It should be noted that in the accompanying drawings, the same reference numerals are assigned to components with essentially the same or similar structures and functions, and repeated descriptions thereof will be omitted.

A liquid crystal display (LCD) includes a liquid crystal panel and a backlight unit. Generally, a liquid crystal panel includes an array substrate and an opposite substrate (for example, a color filter substrate) disposed opposite to each other to form a liquid crystal cell, and a liquid crystal layer is filled between the array substrate and the opposite substrate in the liquid crystal cell. A first polarizer is on the array substrate, and a second polarizer is on the opposite substrate, and a polarization direction of the first polarizer is perpendicular to a polarization direction of the second polarizer, for example. The backlight unit is on a non-display side of the liquid crystal panel for providing a planar light source for the liquid crystal panel. Liquid crystal molecules of the liquid crystal layer are twisted by a driving electric field formed between a pixel electrode on the array substrate and a common electrode on the array substrate or a common electrode on the opposite substrate, so as to control a polarization direction of light passing through the liquid crystal molecules, and transmittance of the light is controlled by the cooperation of the first polarizer and the second polarizer, thereby realizing grayscale display. The backlight unit may be a direct-lit backlight unit or a side-lit backlight unit. A direct-lit backlight unit includes a plurality of point light sources (for example, LEDs) arranged side by side and a diffusion plate. Light emitted by the point light sources is homogenized by the diffusion plate, and then incident on the liquid crystal panel for display.

At present, for example, a liquid crystal display panel with high-resolution has also gradually been applied in a VR equipment. When the VR equipment is used, because the distance from the human eye to the display screen is relatively close, it is easier to perceive the display effect of the display image, and therefore, the requirements for the resolution and display quality of the display panel have also been higher and higher.

For example, for a liquid crystal display panel, a direct-lit backlight unit can be controlled by combining local dimming (LD) technologies and peak driving (PD) technologies, so as to improve the display quality of the display panel. The local dimming technologies can not only reduce power consumption of the display panel, but also realize dynamic dimming of backlight region, greatly improve a contrast of the display image, and improve the display quality of the display panel. By using the peak driving technologies on the basis of the local dimming technologies, the contrast of the display image can be further improved, so as to provide the users with a better visual experience.

Local dimming technology can divide a backlight unit into a plurality of backlight blocks which can be driven individually, and each of the plurality of backlight blocks includes one or more light-emitting diodes (LEDs). According to grayscales that need to be displayed in various parts of display screen, the driving currents of the LEDs of backlight blocks corresponding to these parts can be automatically adjusted, to achieve an independent adjustment to the brightness of each of the plurality of backlight blocks in the backlight unit, so a contrast of the display screen can be improved. Local dimming technologies are generally only applicable to the direct-lit backlight unit, and a plurality of LEDs as the light sources are evenly distributed over an entire backplane, for example. For example, in an exemplary direct-lit backlight unit, a schematic diagram of dividing regions of the LED light sources in the entire backplane is shown in FIG. 1A. A small square as shown in FIG. 1A represents an LED unit, and a plurality of regions separated by broken lines represent a plurality of backlight regions (i.e., backlight blocks). Each of the plurality of backlight regions includes one or more LED units and can be controlled independently of other backlight regions. For example, the LEDs in each of the plurality of backlight block are linked, for example, connected in series, that is, currents passing through the LEDs in a same backlight block are consistent.

Figure 1B:
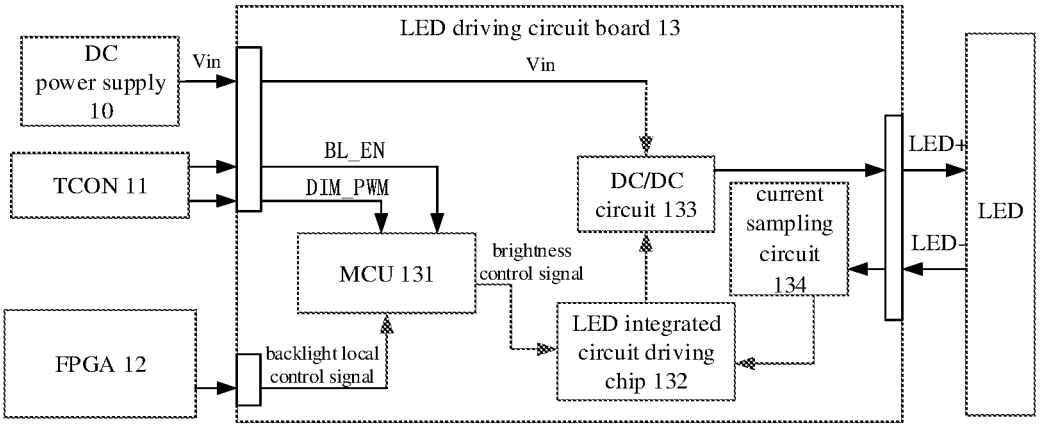
FIG. 1B is a schematic diagram of an exemplary system of performing local dimming process on the backlight unit as shown in FIG. 1A.

FIG. 1B is a schematic diagram of an exemplary system for performing local dimming processing on the backlight unit as shown in FIG. 1A. For example, in some examples, the system is implemented by hardware circuitry. As shown in FIG. 1B, the system includes, for example, a DC power supply 10, a TCON (Timer Control Register) 11, an FPGA (Field-Programmable Gate Array) 12, and an LED driving circuit board 13 for driving the LEDs to emit light. As shown in FIG. 1B, the LED driving circuit board 13 includes a micro-chip unit (MCU) 131, an LED integrated circuit driving chip 132, a DC/DC circuit 133, and a current sampling circuit 134. The LED driving circuit board 13 is configured to process each frame image signal to obtain processed backlight brightness data of each of the plurality of backlight blocks, and generate driving voltages used for various backlight regions based on the backlight brightness data. The driving voltages are output to the corresponding backlight bocks to drive the LEDs in the backlight blocks to emit light.

The MCU 131 receives a backlight local control signal (Local Dimming SPI (Serial Peripheral Interface) signal) from the FPGA 12, a SOC (System on Chip, not as shown in FIG. 1B), or the TCON 11, and the backlight local control signal is used in an "AND" operation (controlling whether the "AND" operation is performed according to an enable signal (BL_EN)) with a brightness modulation signal (DIM_PWM) from the TCON 11 to obtain a brightness control signal of each of the plurality of backlight blocks. Then, the MCU 131 outputs the brightness control signal to the LED integrated circuit driving chip 132 to implement current control of the LEDs of each of the plurality of backlight blocks, thereby controlling the luminance of each of the plurality of backlight blocks.

For example, the system for performing the local dimming processing is powered by an external DC power source 10, and the supply voltage Vin of the power source 10 is typically 24 voltages (V). For example, the DC/DC circuit 133 can employ a voltage conversion circuit (e.g., a Boost circuit) to boost the supply voltage Vin to a driving voltage required by illuminating the LEDs of each of the plurality of backlight blocks, and inputs the driving voltage to each backlight block under the control of the brightness control signal output by the LED integrated circuit driving chip to drive each of the plurality of backlight blocks to emit light.

Because even a small fluctuation of a working voltage applied to the LEDs may cause a large change of the current flowing though the LEDs, the LEDs in the system can be dimmed by a constant-current control mode. To achieve the constant-current control, cathode electrodes (LED−) of the plurality of LEDs connected in series in each of the plurality of backlight blocks is connected to the current sampling circuit 134 to monitor the stability of the currents flowing though LEDs in real time. The current sampling circuit 134 converts the currents flowing through the LEDs into voltage signals and feeds the voltage signals back to the LED integrated circuit driving chip 132, and then the LED integrated circuit driving chip 132 feeds the voltage signals back to the DC/DC circuit 133. After receiving the voltage signals, the DC/DC circuit 133 adjusts an output voltage input to anode electrodes (LED+) of the LEDs to achieve a steady current action on the LEDs. For example, the converted voltage signals are sampled and the sampled voltage signals are compared to a preset reference voltage. In a case where the sampled voltage signals is higher than the reference voltage, the current sampling circuit 134 outputs a control signal to enable the DC/DC circuit 133 to reduce the output voltage, thereby reducing the currents flowing through the LEDs; otherwise, the current sampling circuit 134 outputs another control signal to enable the DC/DC circuit 133 to boost the output voltage to increase the currents flowing through the LEDs. That is, the current sampling circuit 134 can be used as a negative feedback circuit to realize the constant-current control to the LEDs to enable the LEDs to work stably.

The local dimming technologies can adjust the brightness of the corresponding backlight block as shown in FIG. 1A according to the grayscales of screen content (i.e., image) to be displayed by the liquid crystal display panel. For example, for a portion with a higher brightness (grayscale) of the screen in display, the brightness of the backlight block corresponding to the portion is also high, and for a portion with a lower brightness of the screen in display, the brightness of the backlight block corresponding to the portion is also low, so backlight power consumption can be reduced, a contrast of the display screen can be improved, and a display quality can be enhanced.

In a conventional direct-lit backlight source, light emitted from the LED has a certain diffusion angle, leading to light leakage of the backlight blocks, which causes the light emitted from the LED of the backlight blocks that need to display with a high brightness to diffuse to the relatively dark backlight blocks therearound, so that the display brightness of the backlight blocks that display with a high brightness does not reach the display brightness actually required by the display screen, thereby affecting the display quality of the corresponding liquid crystal display screen. Therefore, the peak driving technologies can be used on the basis of the local dimming technologies to achieve increasing the display brightness of the backlight blocks that need to display with a high brightness. For example, the display brightness of the backlight blocks can be increased to be higher than the required display brightness, so as to compensate for the decrease of the display brightness caused by the light leakage problem, and to avoid adverse effects caused by the light leakage problem. For example, the peak driving technologies can increase the currents of the LED of corresponding backlight blocks by increasing backlight values of the backlight blocks to achieve the adjustment of the display brightness thereof.

At present, implementing the local dimming processing and the peak driving processing mentioned above by hardware circuits (for example, an FPGA) is a common method used in display devices including televisions, etc. However, on one hand, the FPGA, as a customized hardware circuit, takes up a certain amount of space, so disposing it in a portable display system (for example, VR system) needs a high cost; on other hand, the program in the FPGA has the characteristics of being easily lost due to power failure, so there is a high requirement for stability of the performance of the display system. Of course, the above processing can also be implemented by software programs (for example, CPU (central processing unit)). However, parallel processing capability of CPU is weak and far weaker than GPU, it consumes time extremely to process the algorithm by CPU, so only static image can be displayed, which cannot meet the requirement for displaying frame rate of devices, such as a television, a mobile phone, etc., upon displaying dynamic images such as video information. In a VR system with a higher requirement for display frame rate, the processing capability of CPU is even worse.

At least one embodiment of the present disclosure provides an image display processing method for a display device, the display device includes a backlight unit and a display panel, the backlight unit includes a plurality of backlight blocks and is driven by a local dimming mode, and the image display processing method includes: obtaining initial backlight data of each of the plurality of backlight blocks corresponding to a display image; performing a peak driving process on the initial backlight data of each of the plurality of backlight blocks by a graphics processing unit to obtain adjusted backlight data of each of the plurality of backlight blocks; and providing the adjusted backlight data to the backlight unit by the graphics processing unit so that the display panel displays the display image.

At least one embodiment of the present disclosure also provides an image display processing device, a display device, and a storage medium corresponding to the image display processing method described above.

The image display processing method provided by the above embodiment of the present disclosure can improve the contrast of the display image and the refresh frequency of the display image by adopting the implementation scheme of implementing the local dimming processing and the peak driving processing by the graphics processing unit, thereby realizing a real-time display of the display image with a high frame rate, and providing users with a better visual experience.

Embodiments of the present disclosure are described in detail below with reference to the accompanying drawings. It should be noted that the same reference numerals in different accompanying drawings will be used to refer to the same elements that have been described.

Figure 2:
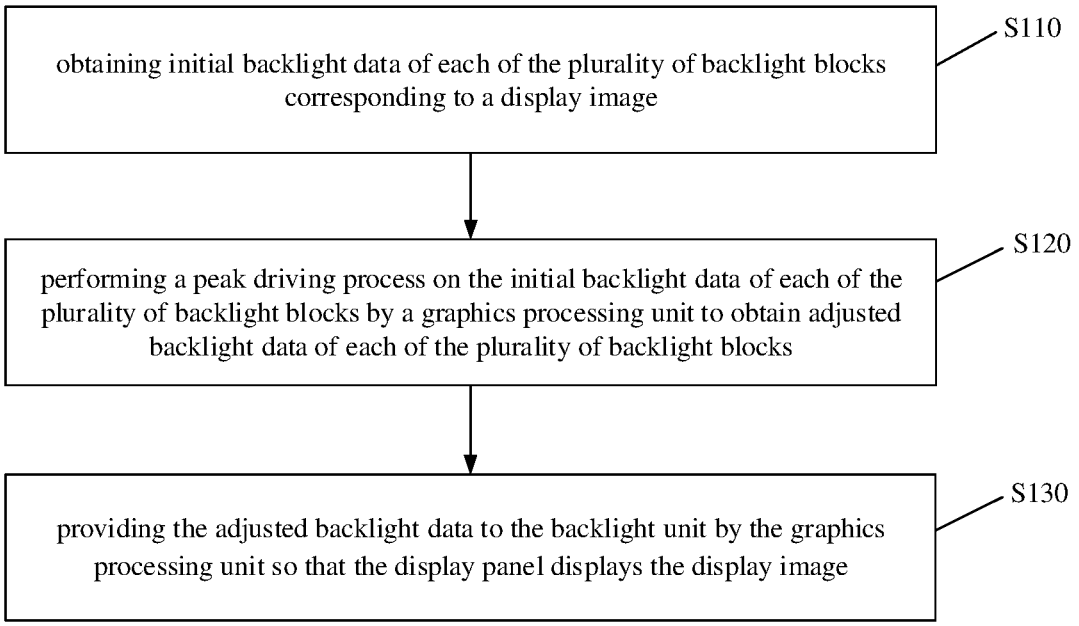
FIG. 2 is a flowchart of an image display processing method provided by some embodiments of the present disclosure.

FIG. 2 is a flowchart of an image display processing method for a display device provided by some embodiments of the present disclosure. For example, the display device includes a backlight unit and a display panel, and the backlight unit includes a plurality of backlight blocks and is driven by a local dimming mode. For example, the display backlight blocks of the backlight unit can be set in a manner as shown in FIG. 1A, or may be set in other manners, which is not limited thereto in the embodiments of the present disclosure. For example, the display device is a liquid crystal (LCD) display device or an electronic paper display device, etc., for example, the display device is a virtual reality device such as a virtual display helmet, etc. The image display processing method can be implemented in software, for example, the image display processing method can be loaded and executed by a graphics processing unit (GPU), to realize a real-time display of the display image with a high frame rate and provide users with a better visual experience. For example, the graphics processing unit can be an internal component of the display device (for example, an integrated form of the VR system), or can be a component of a peripheral device (such as a computer) of the display device (for example, a split form of the VR system), which is not limited thereto in the embodiments of the present disclosure.

For example, the LCD display device may further include a pixel array, a data decoding circuit, a timer control register, a gate driving circuit, a data driving circuit, a storage device (for example, a flash memory or the like) and the like. The data decoding circuit receives a display input signal and decodes the display input signal to obtain a display data signal; and the timing controller outputs timing signals to control the gate driving circuit, the data driving circuit, etc., to work synchronously, and can perform Gamma correction on the display data signal. The processed display data signal is input to the data driving circuit to perform a display operation. These components can be used in a conventional manner and will not be described here again.

Next, an image display processing method for a display device provided by an embodiment of the present disclosure is described with reference to FIG. 2. As shown in FIG. 2, the image display processing method includes steps S110 to S130, which are executed by a graphics processing unit. The steps S110 to S130 of the image display processing method and respective exemplary implementations of the Steps S110 to S130 are respectively described below.

Step S110: obtaining initial backlight data of each of the plurality of backlight blocks corresponding to a display image.

Step S120: performing a peak driving process on the initial backlight data of each of the plurality of backlight blocks by a graphics processing unit to obtain adjusted backlight data of each of the plurality of backlight blocks.

Step S130: providing the adjusted backlight data to the backlight unit by the graphics processing unit so that the display panel displays the display image.

For example, in some embodiments of the present disclosure, "each of the plurality of backlight blocks corresponding to a display image", can be understood as that the backlight blocks overlap with the display image of the display panel in an orthographic projection direction of the display panel (e.g., the direct front direction of the display panel). That is, in some embodiments of the present disclosure, "corresponding" can be understood as overlapping in an orthographic projection direction.

For example, in a display device such as a VR device, because a convex lens disposed in front of the display panel in the display device presents an enlarged image to a viewer (i.e. the viewer views the image displayed on the display panel through the convex lens), etc., the image passing through the convex lens appears a certain degree of distortion (i.e., deformation), and an original image cannot be presented to the viewer normally. Therefore, in some embodiments of the present disclosure, before the display panel displays the original image, distortion correction can be performed on original image data to obtain anti-distortion image data, which is displayed on the display panel to obtain an anti-distortion image, thus, the anti-distortion image enters the human eye after passing through the convex lens, so that the viewer can see a normal (undeformed) image. Display data and backlight data of the anti-distortion image are used for a display operation of the display panel, so in some embodiments of the present disclosure, the anti-distortion image is referred to as a display image. It should be noted that, parameters of the distortion correction are related to the distortion parameters of the display device (for example, parameters of the convex lens), and a method of distortion correction performed on the image can be any conventional method in the art and will not be described here again.

Figure 3:
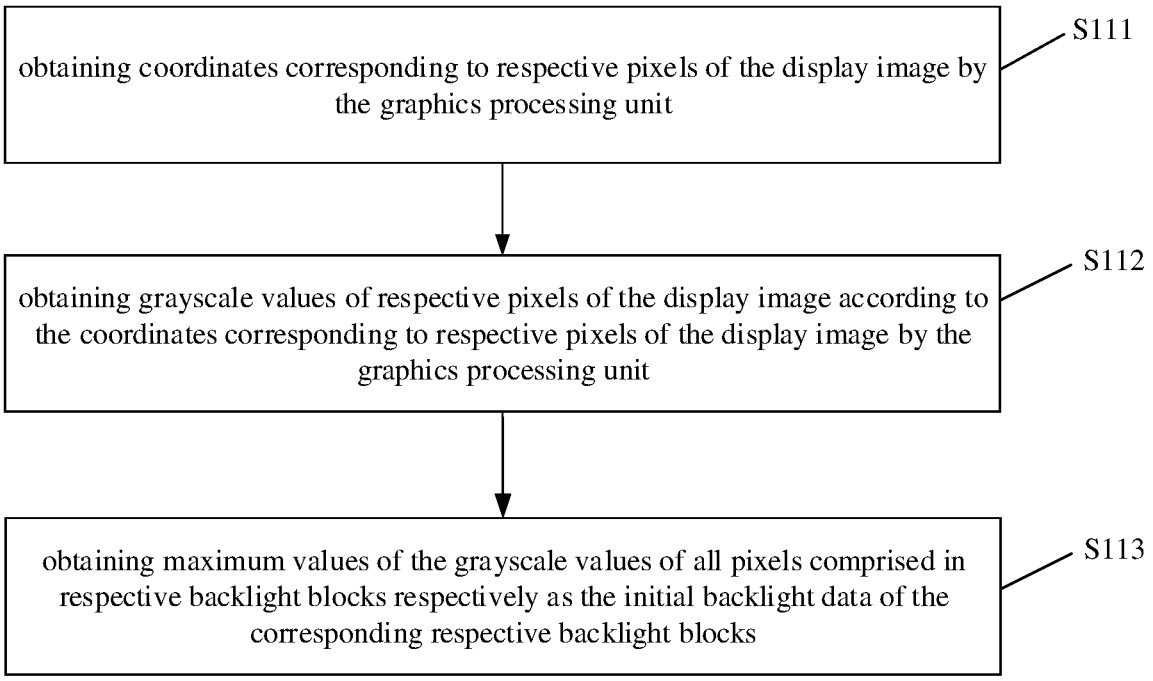
FIG. 3 is a flowchart of a method of obtaining initial backlight data in an image display processing method provided by some embodiments of the present disclosure.

For example, firstly, coordinates of each pixel of the display image in the anti-distortion image are obtained. Then, when the GPU is running, a backlight block corresponding to the pixel and the initial backlight data of the backlight block can be obtained by reading the coordinates of the pixel, therefore, the initial backlight data of each pixel in the display image is obtained. In some examples, a flowchart of a method of obtaining the initial backlight data is shown in FIG. 3, that is, FIG. 3 is a flowchart of an example of step S110 as shown in FIG. 2. As shown in FIG. 3, the method of obtaining the initial backlight data of each of the plurality of backlight blocks corresponding to the display image in the image display processing method includes steps S111 to S113.

Step S111: obtaining coordinates corresponding to respective pixels of the display image by the graphics processing unit.

For example, in the computing process of the graphics processing unit, the coordinates of the respective pixels are used, so the respective pixels is correspond to the coordinates in one-to-one, so that the GPU can obtain relevant information of the respective pixels (for example, grayscale values of the respective pixels) by reading the coordinates of the respective pixels.

Step S112: obtaining the grayscale values of the respective pixels of the display image according to the coordinates corresponding to respective pixels of the display image by the graphics processing unit.

For example, a grayscale value of an pixel in the display image includes grayscale values of three sub-pixels, which includes R, G, B (a red sub-pixel, a green sub-pixel and a blue sub-pixel), of the pixel.

Step S113: obtaining maximum values of the grayscale values of all pixels corresponding to respective backlight blocks respectively as the initial backlight data of the corresponding respective backlight blocks.

After obtaining the grayscale values of the respective pixels in the display image, the initial backlight data of the respective backlight blocks can be determined according to the grayscale values of the respective pixels in the respective backlight blocks. For example, initial backlight data of a backlight block can take the maximum value of the grayscale values of all pixels corresponding to the backlight block. It should be noted that the average value of the grayscale values of all pixels corresponding to the backlight block can be taken as the initial backlight data of the backlight block, which is not limited by the embodiments of the present disclosure. For example, the maximum value or the average value of the grayscale values of the respective pixels can be obtained by any conventional method in the art, and details are not described here again.

For example, a local dimming process and a peak driving processing can be performed on the initial backlight data of respective backlight blocks by the graphics processing unit, that is, the backlight brightness of a backlight block is adjusted to obtain a new backlight brightness of the backlight block, and the new backlight brightness is referred to as adjusted backlight data in the embodiments of the present disclosure. The graphics processing unit can operate in a manner of parallel processing. For example, the graphics processing unit includes a plurality of units, and each of the plurality of units performs a corresponding peak driving process on one block. Therefore, the graphics processing unit can perform the same peak driving algorithm on the backlight data of the plurality of backlight blocks at the same time, so as to obtain the adjusted backlight data corresponding to the plurality of backlight blocks simultaneously, thereby significantly improving the speed of the image processing and reducing the time consumed by the image processing to achieve a real-time display of the display image with a high frame rate.

For example, in a conventional peak driving algorithm, the peak driving process is generally performed on the backlight block having the initial backlight data greater than a preset threshold. For example, the initial backlight data of the backlight block can take the maximum value of the grayscale values of respective pixels in the backlight block. It should be noted that the preset threshold can be determined according to practical experience, or can be determined by a conventional algorithm in the art, which is not limited by the embodiments of the present disclosure.

For example, in step S120, the adjusted backlight data can be obtained by a following formula:

$$L2(n,p)=K*L1(n,p) \quad (1)$$

where L2(n, p) represents the adjusted backlight data of the (n-th, p-th) backlight block of the display image after performing the peak driving process, L1 (n, p) represents the initial backlight data of the (n-th, p-th) backlight block of the display image, K is a peak driving adjustment coefficient, $1 \le n \le I$, $1 \le p \le J$, I and J are integers greater than 1, and I and J represent the number of rows and the number of columns of the array of the plurality of backlight blocks, respectively.

For example, the peak driving adjustment coefficient K is greater than or equal to 1. For example, the peak driving adjustment coefficient K can be taken as 1.1~2, etc. It should be noted that the value of the peak driving adjustment coefficient K depends on the specific situation, which is not limited by the embodiments of the present disclosure.

It should be noted that, the embodiments of the present disclosure do not limit to the above method, the adjusted backlight data can also be obtained according to other conventional methods in the art, and details are not described here again.

After obtained the adjusted backlight data of each of the plurality of backlight blocks, the adjusted backlight data can be provide to the backlight unit by the graphics processing unit, so that the display device provided by the embodiments of the present disclosure displays the above-mentioned display image after performing of the distortion correction. Because of the parallel computing characteristics of the graphics processing unit, the adjusted backlight data of each of the plurality of backlight blocks can be quickly computed and provided to the backlight unit, thereby realizing a real-time display of the display image after improving the contrast with a high refresh frame rate, for example, a refresh frequency of 90 Hz or above.

Figure 4:
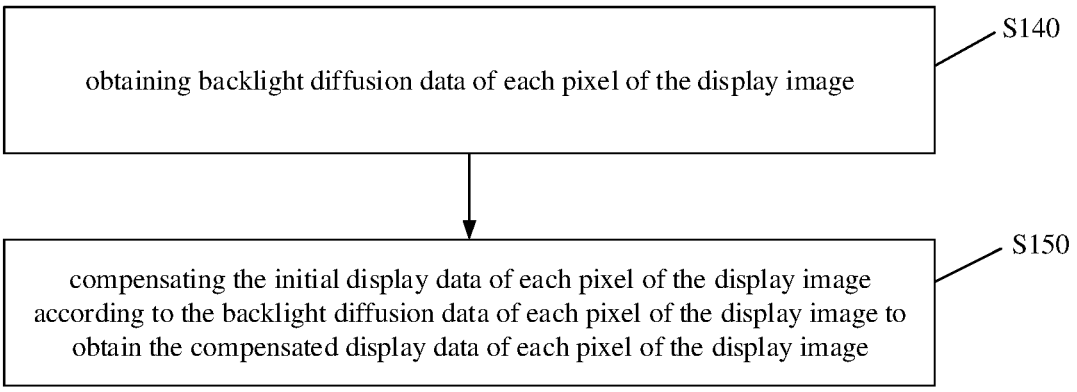
FIG. 4 is a flowchart of a method of obtaining compensated display data provided by some embodiments of the present disclosure.

For example, after obtaining the adjusted backlight data of each of the plurality of backlight blocks of the display image, the initial backlight data of the display image can be compensated according to the adjusted backlight data being obtained, thereby realizing to improve the contrast of the display image. FIG. 4 is a flowchart of a method of obtaining compensated display data provided by at least one embodiment of the present disclosure. As shown in FIG. 4, the method of obtaining the compensated display data includes steps S140 to S150.

Step S140: obtaining backlight diffusion data of each pixel of the display image.

Step S150: compensating initial display data of each pixel of the display image according to the backlight diffusion data of each pixel of the display image to obtain compensated display data of each pixel of the display image.

For example, after obtaining the adjusted backlight data of each of the plurality of backlight blocks in the display image by using the method as shown in FIG. 2, further, the backlight diffusion data of each pixel of the display image is computed according to the adjusted backlight data, and the backlight diffusion data represents the actual backlight brightness of each pixel. Further, the initial display data of each pixel of the display image is compensated according to the backlight diffusion data of each pixel to obtain the compensated display data of each pixel of the display image.

For example, a pixel in the backlight block are described as an example. The adjusted backlight data emitted by respective LEDs in the backlight unit occurs to phenomena such as light diffusion, etc., therefore, the brightness of the backlight emitted by the LEDs located at different positions in the backlight unit has an influence on the backlight diffusion data (actual backlight brightness) of the pixel. For example, the distance between the pixel and the LED is closer, the influence of the brightness of the backlight emitted by the LED on the backlight diffusion data of the pixel is greater. Therefore, the backlight diffusion data of the pixel is obtained by synthesizing the coupling of the brightness emitted by the respective LEDs at different distances in the backlight unit on the pixel. Therefore, it is necessary to fit to obtain a backlight diffusion model of the backlight block according to the distances from the respective LEDs in the backlight blocks to the pixel, and compute the backlight diffusion data corresponding to each pixel in respective backlight blocks according to the backlight diffusion model. For example, the backlight diffusion model can be actually measured according to conventional methods in the art, and details are not described here again.

The display brightness (lighting intensity) of each pixel in the display panel at a certain moment is related not only to the actual backlight brightness at that moment but also to the display data of the pixel (for example, grayscale, which determines the transmittance), therefore, when the backlight brightness changes after performing of the local dimming process and the peak driving process, it may be necessary to perform display compensation process on the display data of the pixel to achieve a desired display brightness for the display panel. For example, the liquid crystal molecules located in the sub-pixels of the liquid crystal panel in front of the backlight source are correspondingly deflected according to the display data signal (for example, a voltage signal corresponding to the grayscale value x) inputted by a driving circuit, to control the degree of transmission (namely, transmittance) of a polarized light formed after light emitted from respective backlight blocks of the LED backlight source passes through a polarizer, thereby displaying corresponding grayscales on the display screen, and realizing to display the image.

For example, the graphics processing unit can fit to obtain a backlight diffusion model according to the adjusted backlight data of each of the plurality of backlight blocks, and obtain the backlight diffusion data of each pixel of the display image according to the backlight diffusion model. Because of the parallel computing characteristics of the graphics processing unit, the time it takes for the graphics processing unit to obtain the backlight diffusion data of each pixel is significantly shorter than the time it takes for the CPU to compute the backlight diffusion data of each pixel.

Figure 5:
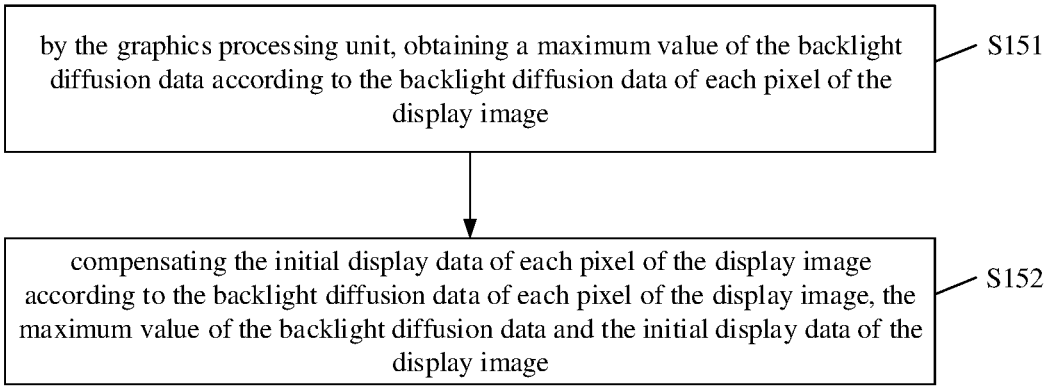
FIG. 5 is a flowchart of some examples of step S150 as shown in FIG. 4.

For example, compensating the initial display data of the display image can also be implemented by the graphics processing unit. FIG. 5 is a flowchart of an example of a method of compensating display data provided by at least one embodiment of the present disclosure, that is, FIG. 5 is a flowchart of an example of step S150 as shown in FIG. 4. The method of compensating the display data includes steps S151 to S152.

Step S151: by the graphics processing unit, obtaining a maximum value of the backlight diffusion data according to the backlight diffusion data of each pixel of the display image.

Step S152: compensating the initial display data of each pixel of the display image according to the backlight diffusion data of each pixel of the display image, the maximum value of the backlight diffusion data and the initial display data of the display image.

After obtaining the backlight diffusion data of each pixel of the display image, the maximum value of the backlight diffusion data can be obtained by the graphics processing unit. For example, the maximum value of the backlight diffusion data can be obtained by conventional methods, such as comparison or sorting one by one, in the art, and details are not described here again. And then the initial display data of each pixel of the display image can be compensated according to the maximum value of the backlight diffusion data, the backlight diffusion data of each pixel and the initial display data of the display image. For example, the compensated display data can be computed according to following formulas (2) to (4). For each pixel of the display image, the compensated display data can be expressed as:

$$R=Hm*A.r+(bl_\max-Y)*A.r \tag{2}$$

$$G=Hm*A.g+(bl_\max-Y)*A.g \tag{3}$$

$$B=Hm*A.b+(bl_\max-Y)*A.b \tag{4}$$

where R, G and B respectively represent compensated display data of three sub-pixels, which includes a red sub-pixel, a green sub-pixel and a blue sub-pixel, of the each pixel; A.r, A.g and A.b respectively represent initial display data of the three sub-pixels of the pixel before performing the local dimming process; bl_max represents the maximum value of the backlight diffusion data; Y represents the backlight diffusion data of the pixel, and Hm represents a greatest grayscale value.

For example, Hm in the formulas (2) to (4) can be 255, where 255 represents the highest grayscale in the case where the grayscale is represented by 8 bits. Of course, in a case where the grayscale is represented by 10 bits, the above parameter Hm can be 1023 instead of 255. The value of the highest grayscale Hm depends on a specific situation, which is not limited by the embodiments of the present disclosure.

For example, in another example, the compensated display data can also be computed according to formula (5) and formula (6) as shown below.

For example, for a pixel displaying a grayscale value x, display brightness thereof can be expressed as:

$$L_x=BLU_x*\eta_x \tag{5}$$

where x represents a grayscale value of a pixel, $L_x$ represents the display brightness of the pixel in a case where the grayscale value is x, $BLU_x$ represents corresponding backlight diffusion data of the pixel in a case where the grayscale value is x, and $\eta_x$ represents a corresponding transmittance of the pixel.

For example, the pixel transmittance $\eta_x$ can be expressed as:

$$\eta_x=(x/Hm)^{\gamma}*\eta_{Hm} \tag{6}$$

where $\eta_{Hm}$ represents the transmittance of the pixel corresponding to the greatest grayscale value Hm, $\gamma$ is a gamma value of the display device, and Hm represents the greatest grayscale value.

For example, after obtaining the actual backlight brightness BLUx of each pixel in the backlight blocks according to the backlight diffusion model, if the desired display brightness Lx of the display panel is to be achieved, the transmittance corresponding to each pixel can be computed according to formula (5); after obtaining the transmittance, the display data of each pixel, that is, the grayscale value x, is computed according to formula (6), thereby realizing the display compensation on the display data of the display image.

Figure 6:
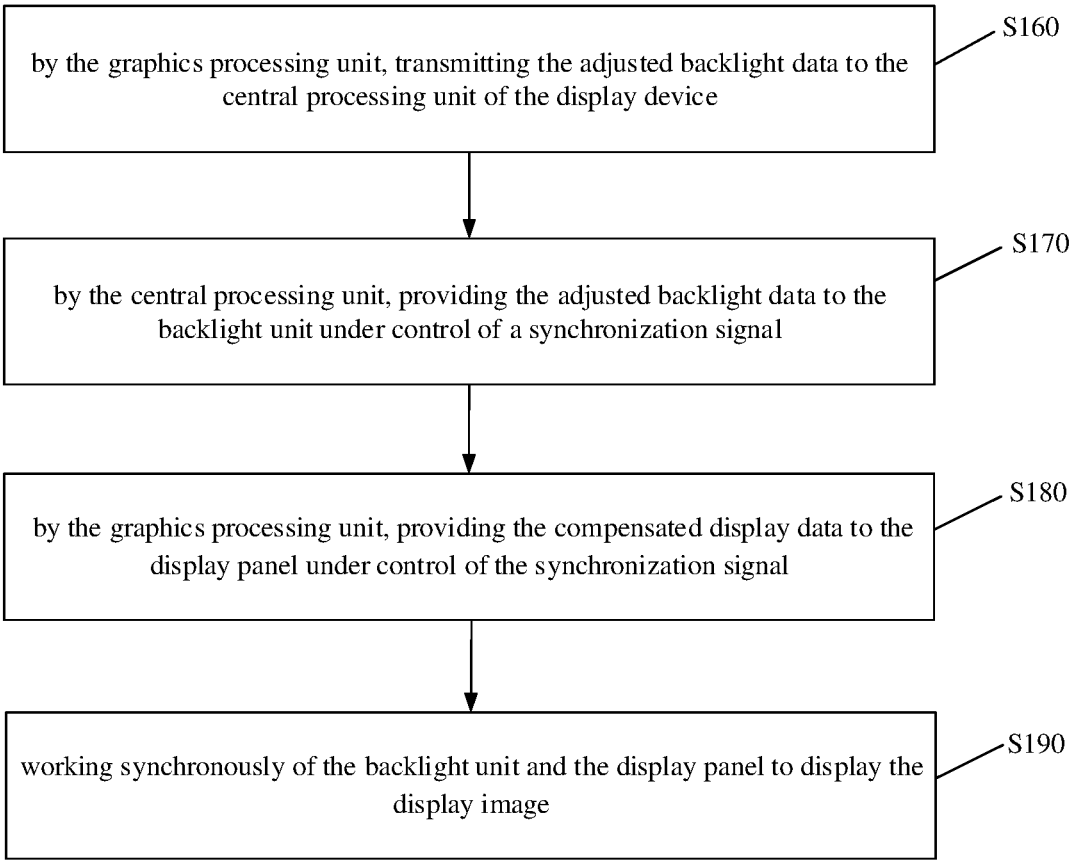
FIG. 6 is a flowchart of an example of a method of synchronously transmitting display data and backlight data provided by some embodiments of the present disclosure.

In the image display processing method provided by at least one embodiment of the present disclosure, after obtaining the adjusted backlight data of each of the plurality of backlight blocks and compensating the display data, in order to realize displaying the display image at a high frame rate, the adjusted backlight data and the compensated display data can also be synchronously transmitted to the display device by the central processing unit and the graphics processing unit. In a case where the display device provided by the embodiments of the present disclosure includes a central processing unit, FIG. 6 is a flowchart of an example of a method of synchronously transmitting compensated display data and adjusted backlight data provided by at least one embodiment of the present disclosure. As shown in FIG. 6, the method of synchronous transmitting includes steps S160 to S190.

Step S160: by the graphics processing unit, transmitting the adjusted backlight data to the central processing unit of the display device.

Step S170: by the central processing unit, providing the adjusted backlight data to the backlight unit under control of a synchronization signal.

Step S180: by the graphics processing unit, providing the compensated display data to the display panel under control of the synchronization signal.

Step S190: working synchronously of the backlight unit and the display panel to display the display image.

For example, the graphics processing can transmit the adjusted backlight data of each of the plurality of backlight blocks generated after performing of the peak driving process to the central processing unit of the display device. According to a setting manner of the graphics processing unit and the central processing unit, the transmission manner can be wired transmission or wireless transmission, the wired transmission can be transmitting by using, for example, a system bus, and the wireless manner can be transmitting by using, for example, WiFi, Bluetooth, etc. The transmission manner depends on a specific situation, which is not specifically limited in the embodiments of the present disclosure.

For example, the synchronization signal relates to the refresh frequency of the image. In the embodiments of the present disclosure, in order to realize the synchronous transmission of the adjusted backlight data and the compensated display data, after receiving the adjusted backlight data, the central processing unit can provide the adjusted backlight data to the backlight unit according to the synchronization signal, and at the same time, the graphics processing unit can provide the compensated display data obtained in step S150 to the display panel of the display device, thereby realizing the synchronous operation of the backlight unit and the display panel under the control of the synchronization signal to display the display image corresponding to the compensated display data. For example, the synchronization signal can be a vertical synchronization signal or a horizontal synchronization signal. Hereinafter, the following is illustrated by taking that the synchronization signal is a vertical synchronization signal as an example.

Figure 7:
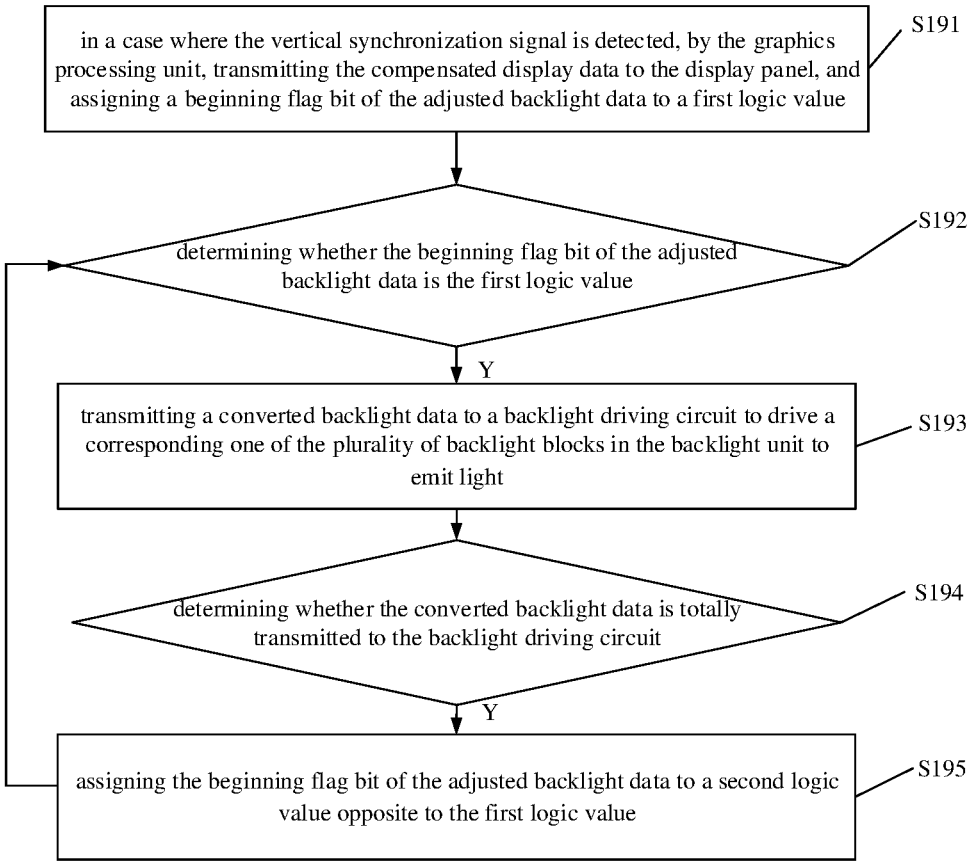
FIG. 7 is a flowchart of some examples of step S190 as shown in FIG. 6.

For example, for a display device such as a VR, which includes two or more display panels (for example, one for either of the left and right eyes), corresponding threads can be additionally opened, so that the central processing unit transmits the adjusted backlight data to the backlight unit of the corresponding display panel through the corresponding thread. In order to realize the synchronous transmission of the display data and the backlight data, and to increase the refresh frequency of the display image, the adjusted backlight data can be transmitted by opening a plurality of sub-threads in addition to the main thread of the central processing unit. FIG. 7 is a flowchart of an example in which the backlight unit and the display panel work synchronously to display the display image, that is, FIG. 7 is a flowchart of an example of step S190 as shown in FIG. 6, namely sub-threads opened in addition to the main thread. For example, the left and right display panels can respectively be set with a sub-thread that controls the transmission of the adjusted backlight data, thereby achieving parallel processing of data and improving data processing efficiency. As shown in FIG. 7, the method of synchronous transmission includes steps S191 to S195.

Step S191: in a case where the vertical synchronization signal is detected, by the graphics processing unit, transmitting the compensated display data to the display panel, and assigning a beginning flag bit of the adjusted backlight data to a first logic value.

Step S192: determining whether the beginning flag bit of the adjusted backlight data is the first logic value, and if yes, executing step S193.

Step S193: transmitting a converted backlight data to a backlight driving circuit to drive a corresponding one of the plurality of backlight blocks in the backlight unit to emit light.

Step S194: determining whether the converted backlight data is totally transmitted to the backlight driving circuit, and if yes, executing step S195.

Step S195: assigning the beginning flag bit of the adjusted backlight data to a second logic value opposite to the first logic value, and returning to step S192.

For example, in the case where the vertical synchronization signal is detected (that is, when beginning to display a new frame of image), the graphics processing unit transmits the compensated display data to the display panel, and at the same time, transmits the adjusted backlight data to the backlight unit. For example, a flag bit can be set in the main thread as shown in FIG. 6, which is referred to as a beginning flag bit of the backlight data in the present example, and the beginning flag bit of the backlight data is assigned to the first logic value in a case where the vertical synchronization signal is detected. The flag bit in a thread is essentially a judgment condition, and different flag bits correspond to different judgment results. For example, the first logical value can be denoted as T (true), and in the present example, when detecting that the beginning flag bit of the backlight data is T, it indicates that step S193 can be executed. If the beginning flag bit of the backlight data is not T, (for example, F, that is, "false", indicating a second logic value), then the process can return to step S192, the flag bit is continuously judged until the condition is met, and then the subsequent steps are executed.

In the step S193, for example, firstly, the adjusted backlight data is converted to obtain the converted backlight data. For example, the adjusted backlight data is grayscale values after performing of the peak driving process, and the converted backlight data is current or voltage signals for driving the LEDs to emit light corresponding to the grayscale values.

In order to achieve a good display effect, in the step S194 and the step S195, it is necessary to determine whether the converted backlight data is totally transmitted to the backlight circuit, and if yes, the beginning flag bit of the backlight data mentioned above is assigned to the second logic value. For example, the second logic value is opposite to the first logical value and can be expressed as F. In the embodiment of the present disclosure, this step indicates that an end of the synchronous transmission process corresponding to the display image, that is, the synchronous transmission of the adjusted backlight data and the compensated display data of one frame of display image is completed. At this time, it is allowed to return to step S192 to continuously judge the logic value of the beginning flag bit of the backlight data, so as to perform synchronous transmission of the adjusted backlight data and the compensated display data of a next frame of display image again when the next frame of image is refreshed. If it is determined that the converted backlight data is not totally transmitted to the backlight driving circuit, step S193 can be executed continuously until the backlight driving circuit corresponding to each of the plurality of backlight blocks obtaining the converted backlight data. For example, transmission of the backlight data in the present example can be realized by the central processing unit.

The first logical value and the second logical value can also be assigned to 0 and 1, respectively, and which are not limited by the embodiments of the present disclosure.

For example, by performing the above-described multi-threaded computing in the GPU and the CPU, the frame refresh rate of the display image is improved, thereby enabling the users to have a better visual experience.

Figure 8:
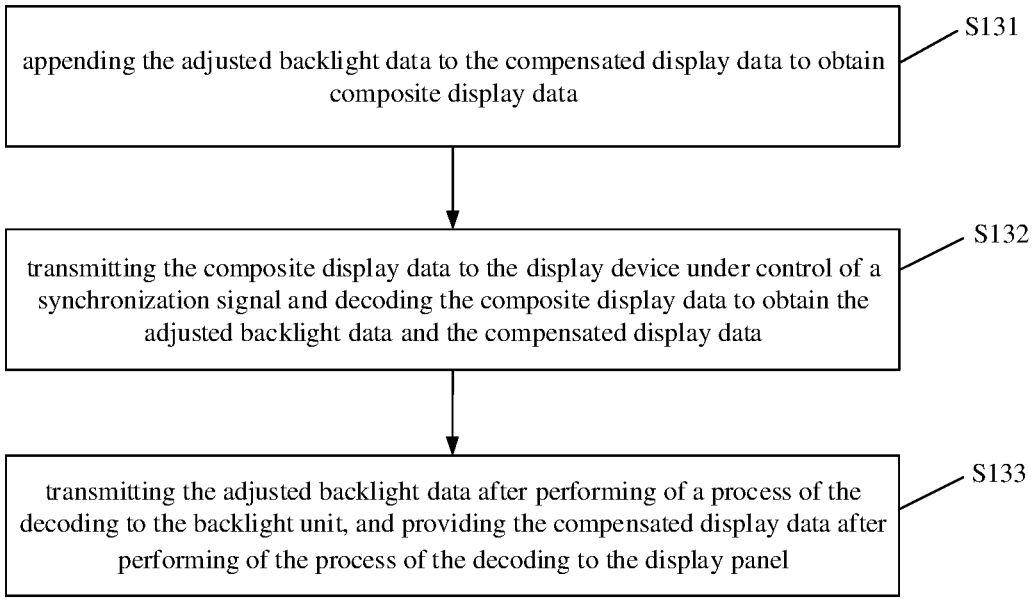
FIG. 8 is a flowchart of another example of a method of synchronously transmitting display data and backlight data provided by some embodiments of the present disclosure.

FIG. 8 is a flowchart of another example of a method of synchronously transmitting the compensated display data and the adjusted backlight data. In the present example, both the compensated display data and the adjusted backlight data are transmitted in the GPU. As shown in FIG. 8, the method of synchronous transmitting includes steps S131 to S133.

Step S131: appending the adjusted backlight data to the compensated display data to obtain composite display data.

Step S132: transmitting the composite display data to the display device under control of a synchronization signal and decoding the composite display data to obtain the adjusted backlight data and the compensated display data.

Step S133: transmitting the adjusted backlight data after performing of a process of the decoding to the backlight unit, and providing the compensated display data after performing of the process of the decoding to the display panel.

For example, after the compensated display data is obtained by the graphics processing unit, the display data can be stored in a form of matrix in the graphics processing unit, so the matrix can be extended, for example, appending a row, a column, or a block matrix, to add the adjusted backlight data obtained by the graphics processing unit in step S120 to the extended portion of the matrix to form a new matrix, which represents the composite display data. For example, in the present example, a new row of pixel data is appended under the compensated display data, and the adjusted backlight data obtained in step S120 is written into the appended row of pixel data to form a stitched image (namely the composite display data).

For example, after the composite display data is obtained, the composite display data is transmitted to the display device under the control of the synchronization signal to realize synchronous transmission of the compensated display data and the backlight data. For example, the display device decodes the composite display data, and the decoding can be implemented by a hardware decoding circuit (for example, a dedicated decoder), or can also be implemented by the central processing unit, or can be implemented by other conventional methods in the art, which is not limited by the embodiments of the present disclosure. The adjusted backlight data and the compensated display data after performing of a process of the decoding can be simultaneously transmitted to the backlight unit and the display panel, respectively, so as to realize synchronous transmission of the adjustment backlight data and the compensated display data of a frame of display image, thereby realizing to display the image after improving the contrast.

For displaying at a high frame rate in the local dimming technologies, it needs to ensure not only that the running time of the algorithm in the graphics processing unit is as short as possible, but also that the time for synchronous transmission of the backlight data and the compensated display data is as short as possible. The graphics processing unit can compute and transmit in parallel, and the time for implementing the above synchronous transmission method is significantly shortened, thereby improving the refresh frame rate of the display device. In addition, the synchronous transmission method in the present example also reduces the use of transmission lines and avoids problems such as resource consumption caused by opening more threads. Moreover, it should be noted that the graphics processing method as shown in FIG. 8 can also be independent of the steps described above, for example, in conjunction with FIG. 2 to FIG. 7, and independently applied to the image processing method of the display device.

For example, the initial backlight data of the display image, the adjustment backlight data, the preset threshold, and other parameters generated during the image display process in the above steps can be stored in a storage of the display panel, and invoked by a processor (for example, a CPU or a GPU) when needed. The following embodiments are the same as the above described, and are not described again.

It should be noted that, in the embodiments of the present disclosure, the flow of the image display processing method may include more or less operations, and these operations can be performed sequentially or in parallel. Although the flow of the image display processing method described above includes a plurality of operations in a specific order, it should be clearly understood that the order of the plurality of operations is not limited. The image processing method described above may be performed once or may be performed a plurality of times according to predetermined conditions. It should be noted that, the following embodiments are the same as the above described, and are not described again.

The image display processing method provided by the above embodiment of the present disclosure can improve the contrast of the display image and the refresh frequency of the display image by adopting the implementation scheme of implementing the local dimming process and the peak driving process with the graphics processing unit, thereby realizing a real-time display of the display image with a high frame rate, and providing users with a better visual experience.

Figure 9A:
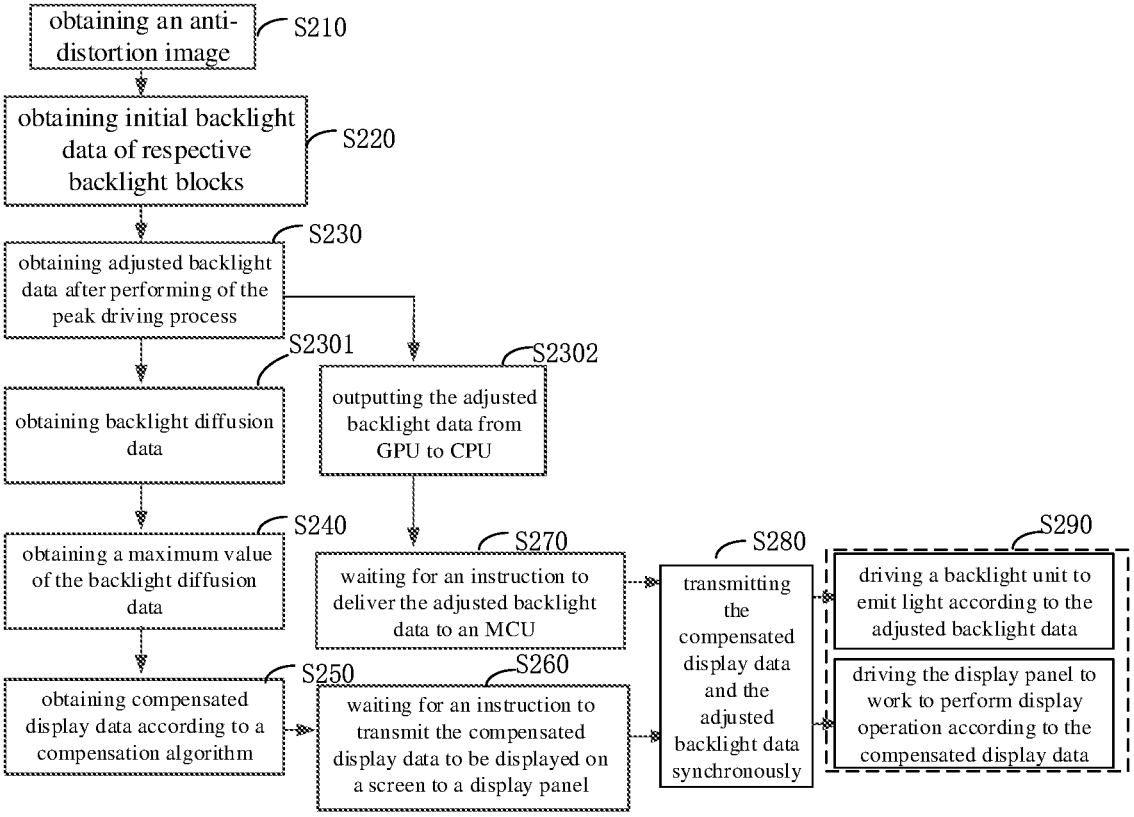
FIG. 9A is a systematic flowchart of an example of an image display processing method provided by some embodiments of the present disclosure.

FIG. 9A is a systematic flowchart of an example of an image display processing method provided by some embodiments of the present disclosure. For example, in the image display processing method, for example, steps S210 to S230, S2301, and S240 to S250 are executed in a GPU, and synchronous transmission of data is realized in conjunction with a CPU. As shown in FIG. 9A, the image display processing method includes steps S210 to S290. Hereinafter, the image display processing method are described in detail in conjunction with steps S210 to S290.

Step S210: obtaining an anti-distortion image.

For example, the anti-distortion image is an image obtained after performing distortion correction on an original image, that is, a display image. Computing in the subsequent process is based on data of the anti-distortion image.

Step S220: obtaining initial backlight data of respective backlight blocks.

For example, the initial backlight data of one backlight block is a maximum value or an average value of the grayscale values of all pixels corresponding to the corresponding backlight block of the anti-distortion image obtained in step S210. For example, the initial backlight data can be obtained through step S111 to step S113, and details are not described here again.

Step S230: obtaining the adjusted backlight data after performing of the peak driving process.

For example, the adjusted backlight data after performing of the peak driving process can be obtained by formula (1), and the peak driving data is used for step S2301 and step S2302, respectively, to perform the subsequent image processing. Steps S2301 to S250 are used for computing the compensated display data according to the adjusted backlight data; and steps S2302 and S270 are for reading the adjusted backlight data from the GPU to the CPU, so as to control the transmission of the adjusted backlight data by the CPU.

Step S2301: obtaining backlight diffusion data.

For example, the backlight diffusion data of each pixel can be obtained according to a backlight diffusion model, and the backlight diffusion data can refer to the related description of step S140 as shown in FIG. 4, and details are not described here again.

Step S240: obtaining a maximum value of the backlight diffusion data.

The backlight diffusion data obtained according to step S2301 can be processed according to a sorting method or a one-by-one comparison method to obtain the maximum value of the backlight diffusion data. Step S240 is similar to step S151, and details are not described here again.

Step S250: obtaining compensated display data according to a compensation algorithm.

The compensation algorithm, for example, can obtain the compensated display data by using the method in formula (2)-formula (4), or can obtain the compensated display data by using the method in formula (5) and formula (6), and details are not described here again.

Step S260: waiting for an instruction to transmit the compensated display data to be displayed on a screen to a display panel.

For example, the compensated display data computed in step S250 is stored in a storage, and when a vertical synchronization signal is detected, the GPU sends a corresponding instruction to control output of the compensated display data.

Step S2302: outputting the adjusted backlight data from GPU to CPU.

For example, the adjusted backlight data is transmitted from GPU to CPU for temporary storage and processing, and the transmission of the adjusted backlight data is controlled by CPU. For example, the transmission of the adjusted backlight data can be controlled by opening an additional sub-thread.

Step S270: waiting for an instruction to deliver the adjusted backlight data to an MCU.

For example, when detecting that a beginning flag bit of the backlight data is T, the CPU sends a corresponding instruction to deliver the adjusted backlight data to the MCU. For example, when the vertical synchronization signal is detected, step S260 is executed, and at the same time, the beginning flag bit of the backlight data is assigned to T, thereby executing step S270.

Step S280: transmitting the compensated display data and the adjusted backlight data synchronously.

For example, in a case where the vertical synchronization signal is detected (that is, when beginning to display a new frame of image), the graphics processing unit transmits the compensated display data to the display panel, and at the same time, transmits the adjusted backlight data to the backlight unit, thereby realizing synchronous transmission of the adjusted backlight data and the compensated display data. For example, a specific implementation process can refer to steps S191 to S195 as shown in FIG. 7.

Step S290: driving a backlight unit to emit light according to the adjusted backlight data; and driving the display panel to work to perform display operation according to the compensated display data.

For example, the compensated display data is transmitted to a driving chip in the display panel, for example, a data driving circuit, for driving deflection of a liquid crystal layer in the display panel; at the same time, the adjusted backlight data is transmitted to the MCU in the LED driving circuit board 13 as shown in FIG. 1B, so that the adjusted backlight data is used to drive LEDs of a corresponding backlight block in the backlight unit to emit light. Therefore, the liquid crystal layer in the display panel controls transmittance of light emitted by the backlight unit, so that the display panel displays a corresponding display image.

Figure 9B:
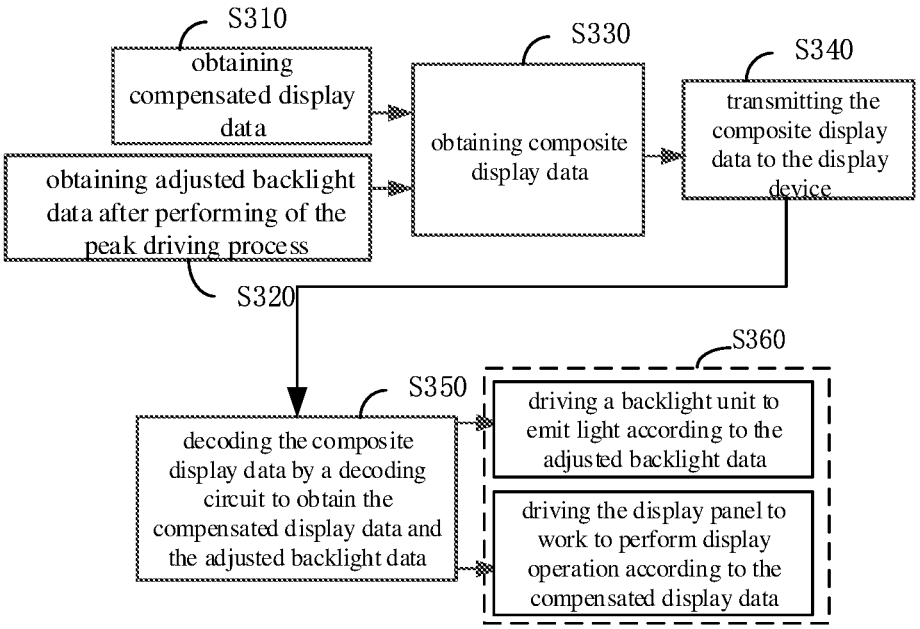
FIG. 9B is a systematic flowchart of an example of a method of synchronously transmitting data provided by some embodiments of the present disclosure.

FIG. 9B is a systematic flowchart of an example of a method of synchronously transmitting data provided by some embodiments of the present disclosure. The method of synchronously transmitting data in the present example can be applied to the image display processing method of the display device alone, or can be applied to the image display processing method as shown in FIG. 9A, and replaces the part of synchronously transmitting data in step S2302, step S260, step S270, step S280 and step S290 as shown in FIG. 9A.

As shown in FIG. 9B, the method of synchronously transmitting data includes steps S310 to S360.

Step S310: obtaining compensated display data.

For example, the compensated display data can be obtained according to the backlight diffusion data, the maximum value of the backlight diffusion data and the initial display data of the display image. For example, the compensated display data can be obtained according to formula (2) to formula (4), and details are not described here again.

Step S320: obtaining adjusted backlight data after performing of the peak driving process.

For example, the adjusted backlight data can be obtained by formula (1) or other conventional methods in the art, and details are not described here again.

Step S330: obtaining composite display data.

For example, in the present example, a new row of pixel data is appended under the compensated display data, and the adjusted backlight data is written into the appended row of the pixel data to form the composite display data. For example, the bottom row of the composite display data is the adjusted backlight data and is written line by line from the adjusted backlight data of the first backlight block in the upper left corner of the backlight unit. For example, this step is similar to step S131 as shown in FIG. 8, and details are not described here again.

Step S340: transmitting the composite display data to the display device.

The composite display data includes the compensated display data and the adjusted backlight data, so synchronous transmission of the adjusted backlight data and the compensated display data can be realized by transmitting the composite display data to the display device. For example, the composite display data is transmitted under the control of a synchronization signal.

Step S350: decoding the composite display data by a decoding circuit to obtain the compensated display data and the adjusted backlight data.

For example, the decoding circuit in the display device decodes the composite display data being received to obtain the compensated display data and the adjusted backlight data, respectively, and transmits the compensated display data and the adjusted backlight data to the display panel and the backlight unit, respective.

Step S360: driving a backlight unit to emit light according to the adjusted backlight data; and driving the display panel to work to perform display operation according to the compensated display data.

For example, the compensated display data is transmitted to a driving chip in the display panel, for example, a data driving circuit, for driving deflection of a liquid crystal layer in the display panel; at the same time, the adjusted backlight data is transmitted to the MCU in the LED driving circuit board 13 as shown in FIG. 1B, so that the adjusted backlight data is used to drive LEDs of a corresponding backlight block in the backlight unit to emit light. Therefore, the liquid crystal layer in the display panel controls transmittance of light emitted by the backlight unit, so that the display panel displays a corresponding display image.

Figure 10A:
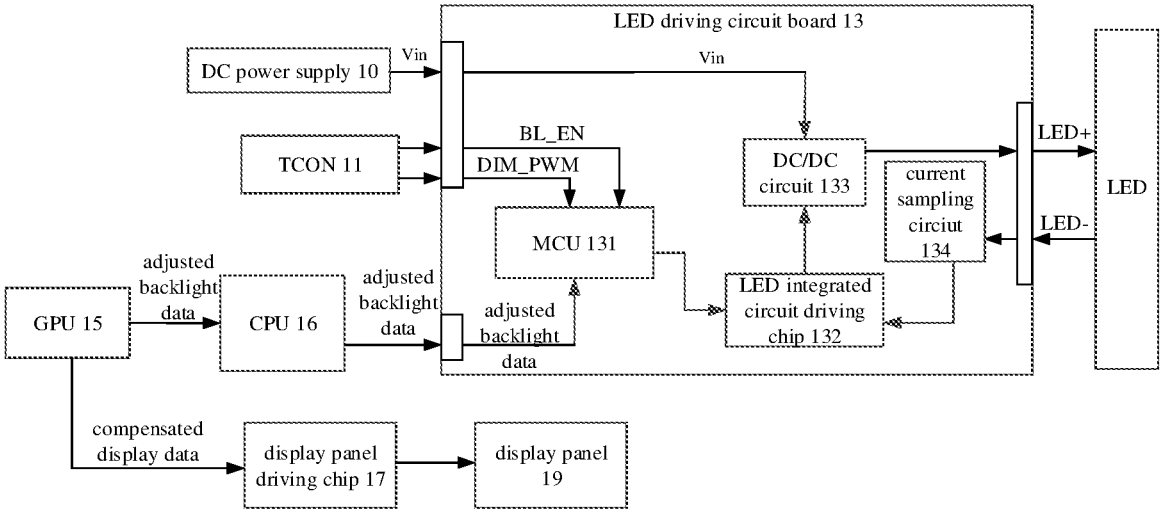
FIG. 10A is a schematic block diagram of an image display processing system provided by some embodiments of the present disclosure.

FIG. 10A is a schematic block diagram of an image display processing system provided by some embodiments of the present disclosure. The image display processing system can implement the synchronous transmission method in steps S160 to S190. The image display processing system is similar to the image display processing system as shown in FIG. 1B, but differs in the following: a GPU 15 as the main data processing device, transmits the adjusted backlight data obtained in step 120 to a CPU 16, and the CPU 16 transmits the adjusted backlight data to a MCU 131 for driving LEDs in the backlight unit to emit light under the control of a synchronization signal; at the same time, the GPU 15 transmits the compensated display data obtained by steps S140 to S150 through a display panel driving chip 17 to a display panel 19, so that the display panel 19 and the backlight unit work synchronously to display the display image. The operation principle of other parts in FIG. 10A can refer to the related description of FIG. 1B, and details are not described here again.

Figure 10B:
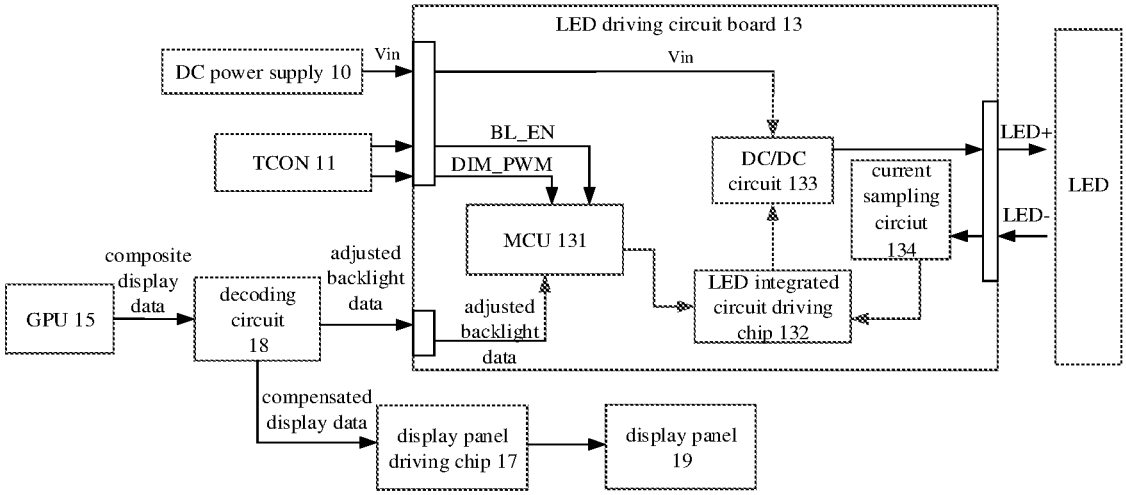
FIG. 10B is a schematic block diagram of another image display processing system provided by some embodiments of the present disclosure.

FIG. 10B is a schematic block diagram of another image display processing system provided by some embodiments of the present disclosure. The image display processing system can implement the synchronous transmission method in steps S131 to S133. In the system, the image display processing method provided by at least one embodiment is performed in the GPU.

The image display processing system is similar to the image display processing system as shown in FIG. 10, but differs in the following: the GPU 15 combines the compensated display data and the adjusted backlight data to form composite display data, and transmits the composite display data to a decoding circuit 18 for decoding under the control of a synchronization signal, to obtain the adjusted backlight data and the compensated display data, and simultaneously the adjusted backlight data and the compensated display data are transmitted to the MCU 131 and the display panel 19, respectively, to control the display panel and the backlight unit to work synchronously. The operation principle of other parts in FIG. 10B can refer to the related description of FIG. 10A, and details are not described here again.

Technical effects of the image display processing systems as shown in FIG. 10A and FIG. 10B can be referred to the technical effects of the image display processing method for the display device provided by the embodiments of the present disclosure, and details are not described here again.

Figure 11:
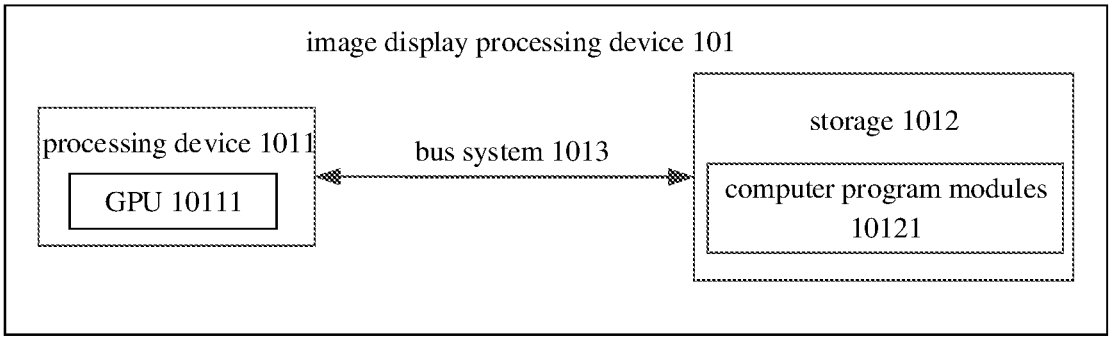
FIG. 11 is a schematic structural diagram of an image display processing device provided by some embodiments of the present disclosure.

FIG. 11 is a schematic structural diagram of an image display processing device provided by some embodiments of the present disclosure. The image display processing device 101 is configured to perform an image display processing method provided by the embodiments of the present disclosure as follows: obtaining initial backlight data of each of the plurality of backlight blocks corresponding to a display image; performing a peak driving process on the initial backlight data of each of the plurality of backlight blocks to obtain adjusted backlight data of each of the plurality of backlight blocks; and providing the adjusted backlight data to the backlight unit so that the display panel displays the display image.

As shown in FIG. 11, the image display processing device 101 can include a processing device 1011, a storage 1012 and one or more computer program modules 10121. For example, the processing device includes a graphics processing unit 10111, which is connected with the storage 1012 by a bus system 1013. For example, the one or more computer program modules 10121 can be stored in the storage 1012. For example, the one or more computer program modules 10121 can include one or more instructions that are executable by a computer used for the image display processing method provided by any one of the embodiments of the present disclosure. For example, the instructions of the one or more computer program modules 221 can be executed by the processing device 1011. For example, the bus system 1013 can be a conventional serial or parallel communication bus, etc., and no limitation is imposed in this aspect in the embodiments of the present disclosure.

For example, the processing device 1011 can be a central processing unit (CPU), or other processing units with a data processing ability and/or instruction execution ability. For example, the processing device 1011 can be a general processing unit or a dedicated processing unit, and can control other components in the image processing device 100 to achieve the expected functions. For example, at least the graphics processing unit performs the peak driving process on the initial backlight data of respective backlight blocks to obtain adjusted backlight data of the respective backlight blocks, and provides the adjusted backlight data to the backlight unit for the display panel to display the display image.

For example, the storage 1012 can include one or more computer program products, and the computer program products includes a computer-readable storage media in various forms. For example, the storage 1012 is a volatile storage and/or a non-volatile storage. The volatile storage, for example, includes a random access memory (RAM) and/or a cache memory, etc. The non-volatile storage, for example, includes a read-only memory (ROM), a hard disk, and a flash memory, etc. One or more computer program instructions can be stored in the computer-readable storage medium, and the processing device 1011 can run or execute the program instructions to realize the functions (which are to be realized by the processing device 1012) in the embodiments of the present disclosure and/or other expected functions, such as obtaining the initial backlight data of respective backlight blocks corresponding to the display image, etc. Various applications and data, such as a preset threshold and various data used and/or generated by application programs, etc., can also be stored in the computer-readable storage medium.

It should be noted that in order to be clear and concise, the present embodiment of the disclosure does not illustrate all components of the image display processing device 101. Those skilled in the art can provide and arrange other components, which are not illustrated in the figures, of the image display processing device 101 according to actual requirements to achieve necessary functions of the image display processing device 101.

Technical effects of the image display processing device 101 provided by the embodiment of the present disclosure can be referred to the technical effects of the image display processing method for the display device provided by the embodiments of the present disclosure, and details are not described here again.

Figure 12:
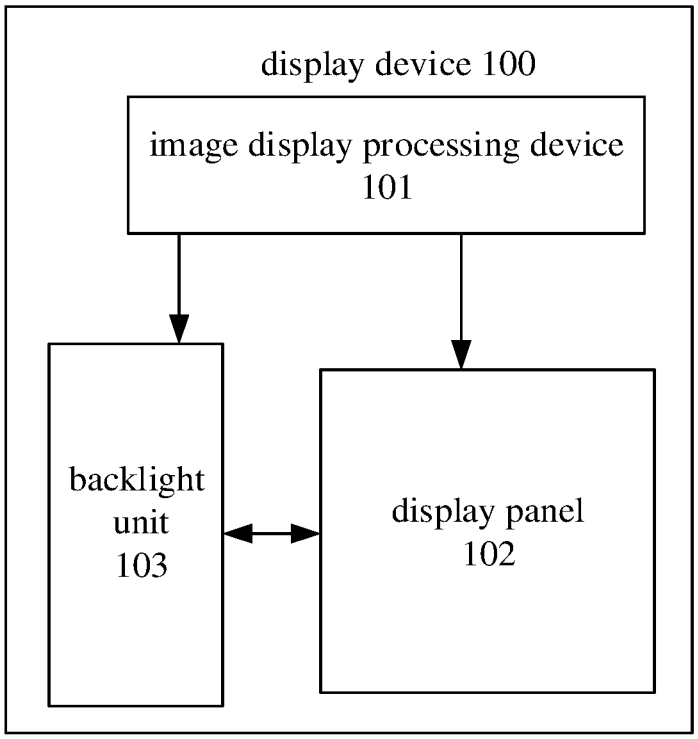
FIG. 12 is a schematic diagram of a display device provided by some embodiments of the present disclosure.

Some embodiments of the present disclosure also provide a display device 100. The display device 100 can include an image display processing device provided by any one of the embodiments of the present disclosure, such as the image display processing device 101 as shown in FIG. 11. For example, the display device 100 can improve the contrast of the display image, and meanwhile, can also realize displaying the display image at a high frame rate, thereby providing the user with a better visual experience. FIG. 12 is a schematic structural diagram of a display device 100 provided by some embodiments of the present disclosure. As shown in FIG. 12, the display device 100 includes an image display processing device 101, a display panel 102 and a backlight unit 103. For example, the backlight unit 103 can include a plurality of backlight blocks and be driven by a local dimming mode.

For example, the image display processing device 101 generates the adjusted backlight data and the compensated display data. The adjusted backlight data is transmitted to, for example, an LED driving circuit board in the backlight unit 103, thereby controlling LEDs in a corresponding backlight block of the backlight unit to emit light; at the same time, the compensated display data is transmitted to, for example, a driving chip in the display panel 102 (not shown in FIG. 12, for example, a data driving circuit), for controlling deflection of liquid crystal molecules of a liquid crystal layer in the display panel to enable the light emitted from the backlight unit to pass though the liquid crystal layer, thereby displaying the display image on the display panel 102.

For example, the display device 100 can be a thin film transistor liquid crystal display device, an electronic paper display device, or the like. For example, the display device is a VR device, such as a VR helmet or the like, and the embodiments of the present disclosure are not limited to this case.

For example, these components are interconnected by a bus system and/or other coupling mechanisms (not shown in figures). For example, the bus system can be a conventional serial or parallel communication bus, etc., and the embodiments of the present disclosure do not limit to this case. It should be noted that the components and structures of the display device 100 as shown in FIG. 12 are merely exemplary and not limiting, and the display device 100 can have other components and structures as needed.

It should be noted that in order to be clear and concise, the present embodiment of the disclosure does not illustrate all components of the display device. Those skilled in the art can provide and arrange other components, which are not illustrated in the figures, of the display device according to actual requirements to achieve necessary functions of the display device.

Technical effects of the display device 100 can be referred to the technical effects of the image display processing method for the display device provided by the embodiments of the present disclosure, and details are not described here again.

Figure 13:
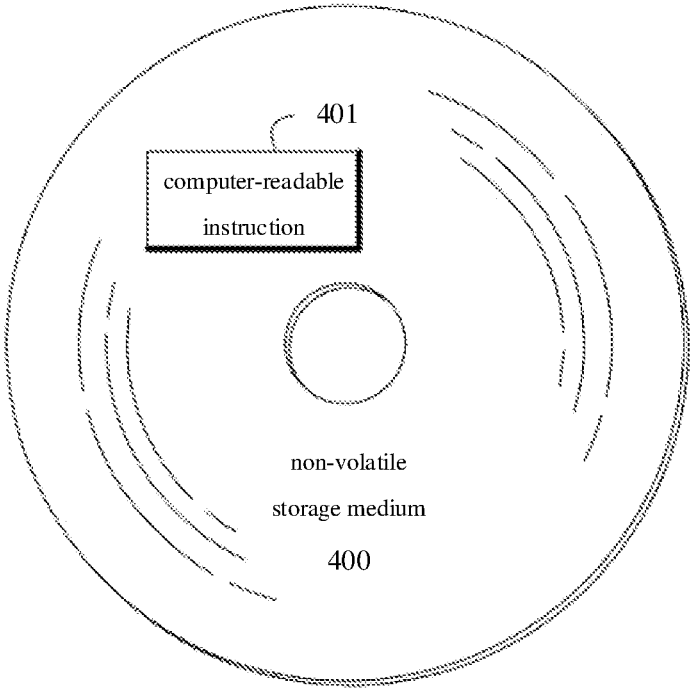
FIG. 13 is a schematic diagram of a non-volatile storage medium provided by some embodiments of the present disclosure.

Some embodiments of the present disclosure also provide a non-volatile storage medium. FIG. 13 is a schematic structural diagram of a non-volatile storage medium provided by some embodiments of the present disclosure. As shown in FIG. 13, for example, the non-volatile storage medium 400 can store a computer-readable instruction 401 non-transitorily, and in a case where the computer-readable instruction 401 stored non-transitorily is executed by a computer (for example, a graphics processing unit), the image display processing method provided by any one of the embodiments of the present disclosure can be executed as follows: obtaining initial backlight data of each of the plurality of backlight blocks corresponding to a display image; performing a peak driving process on the initial backlight data of each of the plurality of backlight blocks to obtain adjusted backlight data of each of the plurality of backlight blocks; and providing the adjusted backlight data to the backlight unit so that the display panel displays the display image.

For example, the non-volatile storage medium 400 is any combination of one or more computer-readable storage media. For example, one computer-readable storage medium includes computer-readable program codes used for obtaining the initial backlight data of each of the plurality of backlight blocks corresponding to the display image, and another computer-readable storage medium includes computer-readable program codes used for performing the peak driving process on the initial backlight data of each of the plurality of backlight blocks to obtain the adjusted backlight data of each of the plurality of backlight blocks. For example, in a case where the program code is read by the computer, the program code stored in the computer-readable storage medium is executed by the computer, and for example, the image display processing method provided by the embodiments of the present disclosure is executed.

For example, the storage medium 400 can include a memory card of a smart phone, a storage component of a tablet, a hard disk of a personal computer, a random access memory (RAM), a read-only memory (ROM), a erasable programmable read-only memory (EPROM), a portable compact disk read-only memory (CD-ROM), a flash memory, or any combination of the above-mentioned storage media, or other suitable storage medium.

The foregoing merely are exemplary embodiments of the disclosure, and not intended to define the scope of the disclosure, and the scope of the disclosure is determined by the appended claims.

What is claimed is:

1. An image display processing method for a display device, the display device comprising a backlight unit and a display panel, the backlight unit comprising a plurality of backlight blocks and being driven by a local dimming mode, and the image display processing method comprising:

obtaining initial backlight data of each of the plurality of backlight blocks corresponding to a display image;

performing a peak driving process on the initial backlight data of each of the plurality of backlight blocks by a graphics processing unit in a manner of parallel processing to obtain adjusted backlight data of each of the plurality of backlight blocks in parallel; and providing the adjusted backlight data to the backlight unit by the graphics processing unit so that the display panel displays the display image, wherein obtaining the initial backlight data of each of the plurality of backlight blocks corresponding to the display image comprises:

obtaining coordinates corresponding to respective pixels of the display image by the graphics processing unit;

obtaining grayscale values of respective pixels of the display image according to the coordinates corresponding to respective pixels of the display image by the graphics processing unit; and obtaining maximum values of the grayscale values of all pixels corresponding to respective backlight blocks respectively as the initial backlight data of the corresponding respective backlight blocks.

2. The image display processing method according to claim 1, further comprising:

obtaining backlight diffusion data of each pixel of the display image; and compensating initial display data of each pixel of the display image according to the backlight diffusion data of each pixel of the display image to obtain compensated display data of each pixel of the display image.

3. The image display processing method according to claim 2, wherein the graphics processing unit fits to obtain a backlight diffusion model according to the adjusted backlight data of each of the plurality of backlight blocks, and obtains the backlight diffusion data of each pixel of the display image according to the backlight diffusion model.

4. The image display processing method according to claim 2, wherein compensating the initial display data of each pixel of the display image according to the backlight diffusion data of each pixel of the display image comprises:

by the graphics processing unit, obtaining a maximum value of the backlight diffusion data according to the backlight diffusion data of each pixel of the display image, and then compensating the initial display data of each pixel of the display image according to the backlight diffusion data of each pixel of the display image, the maximum value of the backlight diffusion data and the initial display data of the display image.

5. The image display processing method according to claim 4, wherein the compensated display data of each pixel are expressed as:

$$R=Hm*A.r+(bl_\max-Y)*A.r;$$

$$G=Hm*A.g+(bl_\max-Y)*A.g;$$

$$B=Hm*A.b+(bl_\max-Y)*A.b;$$

where R, G and B respectively represent compensated display data of three sub-pixels, which comprises a red sub-pixel, a green sub-pixel and a blue sub-pixel, of the each pixel; A.r, A.g and A.b respectively represent initial display data of the three sub-pixels of the pixel before performing local dimming; bl_max represents the maximum value of the backlight diffusion data; Y represents the backlight diffusion data of the pixel, and Hm represents a greatest grayscale value.

6. The image display processing method according to claim 2, wherein providing the adjusted backlight data to the backlight unit by the graphics processing unit so that the display panel displays the display image further comprises:

appending the adjusted backlight data to the compensated display data to obtain composite display data;

transmitting the composite display data to the display device under control of a synchronization signal and decoding the composite display data to obtain the adjusted backlight data and the compensated display data; and transmitting the adjusted backlight data after performing of a process of the decoding to the backlight unit, and providing the compensated display data after performing of the process of the decoding to the display panel.

7. The image display processing method according to claim 1, wherein the display device further comprises a central processing unit;

the graphics processing unit transmits the adjusted backlight data to the central processing unit of the display device; and the central processing unit provides the adjusted backlight data to the backlight unit under control of a synchronization signal.

8. The image display processing method according to claim 7, wherein the graphics processing unit provides compensated display data to the display panel under control of the synchronization signal; and the backlight unit and the display panel work synchronously to display the display image.

9. The image display processing method of claim 8, wherein the synchronization signal is a vertical synchronization signal, and operation that the backlight unit and the display panel work synchronously to display the display image comprises:

in a case where the vertical synchronization signal is detected, by the graphics processing unit, transmitting the compensated display data to the display panel, and assigning a beginning flag bit of the adjusted backlight data to a first logic value;

determining whether the beginning flag bit of the adjusted backlight data is the first logic value;

in a case where the beginning flag bit of the adjusted backlight data is the first logic value, converting the adjusted backlight data to obtain converted backlight data; and transmitting the converted backlight data to a backlight driving circuit to drive a corresponding one of the plurality of backlight blocks in the backlight unit to emit light.

10. The image display processing method according to claim 9, wherein the operation that the backlight unit and the display panel work synchronously to display the display image further comprises:

after transmitting the converted backlight data to the backlight driving circuit, assigning the beginning flag bit of the adjusted backlight data to a second logic value opposite to the first logic value.

11. The image display processing method according to claim 1, further comprising:

performing distortion correction on an original image to obtain the display image.

12. An image display processing device, comprising:

a processing device, comprising a graphics processing unit;

a storage, storing computer executable instructions;

wherein, in a case where the computer executable instructions is executed by the processing device, the processing device executes the image display processing method according to claim 1.

13. The image display processing device according to claim 12, further comprising a central processing unit, wherein the central processing unit is configured to receive the adjusted backlight data transmitted from the graphics processing unit and provide the adjusted backlight data to the backlight unit under control of a synchronization signal.

14. The image display processing device according to claim 13, wherein the graphics processing unit is configured to provide compensated display data to the display panel under control of the synchronization signal, to enable that the backlight unit and the display panel work in synchronously to display the display image.

15. The image display processing device according to claim 12, further comprising a decoding circuit in a case where composite display data are obtained by the graphics processing unit, wherein the decoding circuit is configured to decode the composite display data into the adjusted backlight data and compensated display data, to provide the adjusted backlight data to the backlight unit, and to provide the compensated display data to the display panel.

16. A display device, comprising:

the image display processing device according to claim 13, a backlight unit, and a display panel.

17. The display device according to claim 16, wherein the backlight unit comprises a plurality of backlight blocks and is driven by a local dimming mode.

18. A non-transitory computer readable medium, storing a computer-readable instruction non-transitorily, in a case where the computer-readable instruction stored non-transitorily is executed by a processing device comprising a graphics processing unit, the processing device executes a following method of:

obtaining initial backlight data of each of the plurality of backlight blocks corresponding to a display image;

performing a peak driving process on the initial backlight data of each of the plurality of backlight blocks by a graphics processing unit in a manner of parallel processing to obtain adjusted backlight data of each of the plurality of backlight blocks in parallel; and providing the adjusted backlight data to the backlight unit by the graphics processing unit so that the display panel displays the display image, wherein obtaining the initial backlight data of each of the plurality of backlight blocks corresponding to the display image comprises:

obtaining coordinates corresponding to respective pixels of the display image by the graphics processing unit;

obtaining grayscale values of respective pixels of the display image according to the coordinates corresponding to respective pixels of the display image by the graphics processing unit; and obtaining maximum values of the grayscale values of all pixels corresponding to respective backlight blocks respectively as the initial backlight data of the corresponding respective backlight blocks.

19. An image display processing method for a display device, the display device comprising a backlight unit and a display panel, the backlight unit comprising a plurality of backlight blocks and being driven by a local dimming mode, and the image display processing method comprising:

obtaining initial backlight data of each of the plurality of backlight blocks corresponding to a display image;

performing a peak driving process on the initial backlight data of each of the plurality of backlight blocks by a graphics processing unit to obtain adjusted backlight data of each of the plurality of backlight blocks; and providing the adjusted backlight data to the backlight unit by the graphics processing unit so that the display panel displays the display image;

obtaining backlight diffusion data of each pixel of the display image; and compensating initial display data of each pixel of the display image according to the backlight diffusion data of each pixel of the display image to obtain compensated display data of each pixel of the display image;

wherein compensating the initial display data of each pixel of the display image according to the backlight diffusion data of each pixel of the display image comprises:

by the graphics processing unit, obtaining a maximum value of the backlight diffusion data according to the backlight diffusion data of each pixel of the display image, and then compensating the initial display data of each pixel of the display image according to the backlight diffusion data of each pixel of the display image, the maximum value of the backlight diffusion data and the initial display data of the display image, wherein obtaining the initial backlight data of each of the plurality of backlight blocks corresponding to the display image comprises:

obtaining coordinates corresponding to respective pixels of the display image by the graphics processing unit;

obtaining grayscale values of respective pixels of the display image according to the coordinates corresponding to respective pixels of the display image by the graphics processing unit; and obtaining maximum values of the grayscale values of all pixels corresponding to respective backlight blocks respectively as the initial backlight data of the corresponding respective backlight blocks.

* * * * *